United States Patent [19]

Ishida et al.

[11] Patent Number: 4,548,176

[45] Date of Patent: Oct. 22, 1985

[54] ROTATING MECHANISM OF THROTTLE VALVE FOR FUEL SUPPLY DEVICE OF INTERNAL COMBUSTION ENGINE

[75] Inventors: Takashi Ishida; Kenshi Shimizu, both of Kanagawa; Shuichi Kamiyama, Tokyo, all of Japan

[73] Assignee: Mikuni Kogyo Co., Ltd., Tokyo, Japan

[21] Appl. No.: 659,431

[22] Filed: Oct. 10, 1984

[30] Foreign Application Priority Data

Oct. 14, 1983 [JP] Japan ..... 58-192664

[51] Int. Cl.[4] ..... F02M 19/12

[52] U.S. Cl. ..... 123/342; 123/396; 123/198 D

[58] Field of Search ..... 123/343, 361, 376, 377, 123/396–400, 403, 342, 198 D

[56] References Cited

U.S. PATENT DOCUMENTS 4,122,819 10/1978 Moshofsky et al. ..... 123/198 D
4,424,785 1/1984 Ishida et al. ..... 123/400
4,462,357 7/1984 Lockhart ..... 123/361

*Primary Examiner*—William A. Cuchlinski, Jr.
*Attorney, Agent, or Firm*—Parkhurst & Oliff

[57] ABSTRACT

The invention relates to a rotating mechanism of a throttle valve for a fuel supply device of an internal combustion engine. The mechanism has an actuator for opening the throttle valve upon depressing of an accelerator, a cam lever pivotally secured to a throttle shaft and having a cam set to open the throttle valve more than the movement of said actuator upon depressing of the accelerator, a throttle lever for coupling the cam lever to the throttle shaft, and an engaging member mounted at the cam lever side to take an engaging position or a nonengaging position of the throttle lever. In this rotating mechanism of the throttle valve, the engaging member can operate to take the engaging position with respect to the throttle shaft when the actuator becomes impossible to operate. Thus, the rotating mechanism can operate the throttle valve by the operation of an engaging member to take an engaging position or nonengaging position of a throttle lever having a cam set to open the throttle valve more than the movement of an actuator of a stepping motor or a DC motor for opening the throttle valve in response to the depression of an accelerator without using the actuator even if the stepping motor or the DC motor becomes defective to cause the throttle valve to become impossible to operate. The invention thus allows the vehicle to travel and to accelerate the increase in an air amount by opening the throttle valve more than the movement of a stepping motor as an actuator by the cam lever particularly when the vehicle is necessary to be abruptly accelerated in case like racing thereby preferably accelerating the vehicle.

5 Claims, 3 Drawing Figures

ROTATING MECHANISM OF THROTTLE VALVE FOR FUEL SUPPLY DEVICE OF INTERNAL COMBUSTION ENGINE

BACKGROUND OF THE INVENTION

This invention relates to a rotating mechanism of a throttle valve for a fuel supply device of an internal combustion engine. More particularly, the invention relates to a rotating mechanism of a throttle valve adapted to operate the throttle valve by the operation of an engaging member to take an engaging position or nonengaging position of a throttle lever having a cam set to open the throttle valve more than the movement of an actuator of a stepping motor or a DC motor for opening the throttle valve in response to the depression of an accelerator without using the actuator even if the stepping motor or the DC motor becomes defective to cause the throttle valve to become impossible to operate. The invention thus allows the vehicle to travel as well as to accelerate the increase in an air amount by opening the throttle valve more than the movement of a stepping motor as an actuator by the cam lever particularly when the vehicle is necessary to be abruptly accelerated in case of racing, thereby preferably accelerating the vehicle.

In a conventional rotating mechanism of a throttle valve for a fuel supply device of an internal combustion engine, when a stepping motor or a DC motor for actuating the throttle valve becomes defective due to the disconnection of wirings or other cause or a control unit in the fuel supply device becomes defective, the throttle valve does not normally operate so that the internal combustion engine stops with the result that a vehicle cannot travel. Further, when a stepping motor is used as an actuator for operating the throttle valve, a reduction gear ratio is increased so as to improve air amount resolving power between steps of the stepping motor. Thus, the response of the stepping motor upon accelerating of the motor is deteriorated, and it becomes impossible to abruptly accelerate the motor.

SUMMARY OF THE INVENTION

A primary object of this invention is to provide a rotating mechanism of a throttle valve for a fuel supply device of an internal combustion engine for a vehicle which can operate the throttle valve by the operation of an engaging member to take an engaging position or nonengaging position of a throttle lever having a cam set to open the throttle valve more than the movement of an actuator of a stepping motor or a DC motor for opening the throttle valve in response to the depression of an accelerator without using the actuator even if the stepping motor or the DC motor becomes defective to cause the throttle valve to become impossible to operate, thereby allowing the vehicle to travel.

Another object of this invention is to provide a rotating mechanism of a throttle valve for a fuel supply device of an internal combustion engine which can accelerate the increase in an air amount by opening the throttle valve more than the movement of a stepping motor as an actuator by the cam lever particularly when the vehicle is necessary to be abruptly accelerated in case like racing, thereby preferably accelerating the vehicle.

According to one aspect of this invention there is provided a rotating mechanism of a throttle valve for a fuel supply device of an internal combustion engine which comprises an actuator for opening the throttle valve upon depressing of an accelerator, a cam lever pivotally secured to a throttle shaft and having a cam set to open the throttle valve more than the movement of said actuator upon depressing of the accelerator, a throttle lever for coupling the cam lever to the throttle shaft, and an engaging member mounted at the cam lever side to take an engaging position or a nonengaging position of the throttle lever. In this rotating mechanism of the throttle valve, the engaging member can operate to take the engaging position with respect to the throttle shaft when said actuator becomes impossible to operate. Thus, the rotating mechanism can operate the throttle valve by the operation of an engaging member to take an engaging position or nonengaging position of a throttle lever having a cam set to open the throttle valve more than the movement of an actuator of a stepping motor or a DC motor for opening the throttle valve in response to the depression of an accelerator without using the actuator even if the stepping motor or the DC motor becomes defective to cause the throttle valve to become impossible to operate, thereby allowing the vehicle to travel and to accelerate the increase in an air amount by opening the throttle valve more than the movement of a stepping motor as an actuator by the cam lever particularly when the vehicle is necessary to be absuptly accelerated in case like racing, thereby preferably accelerating the vehicle.

BRIEF DESCRIPTION OF THE DRAWINGS

These and other objects of the invention will be seen by reference to the description, taken in connection with the accompanying drawings, in which.

DESCRIPTION OF THE PREFERRED EMBODIMENTS

An embodiment of this invention will now be described in more detail with reference to the accompanying drawings.

Figure 1:
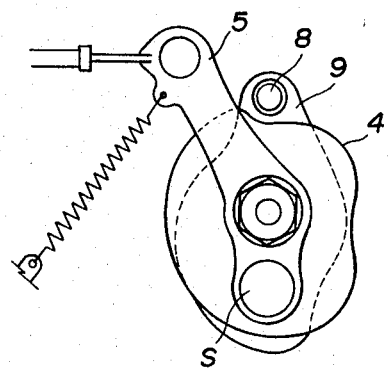
FIG. 1 is a schematic front view of an embodiment of a rotating mechanism of a throttle valve for a fuel supply device of an internal combustion engine constructed in accordance with the present invention.
Figure 2:
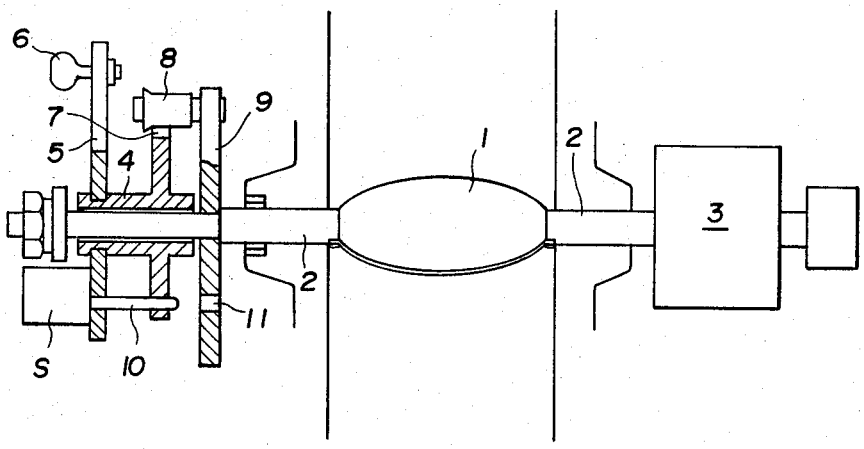
FIG. 2 is a schematic side view of the embodiment illustrated in FIG. 1.

FIGS. 1 and 2 show an embodiment of a rotating mechanism of a throttle valve according to this invention.

As shown, an actuator 3 for operating a throttle valve 1 is coupled to one side of a throttle shaft 2, to which the throttle valve 1 is fastened. The actuator 3 is operated to determine the opening of the throttle valve 1 upon depressing of an accelerator 6 ordinarily by means of a potentiometer, an encoder and a control unit (not shown).

A cam lever 4 is pivotally secured to the other side of the throttle shaft 2, and the lever 4 is coupled to an accelerator 6 through a link lever 5. The cam lever 4 has a cam 7 set to open the throttle valve 1 for maintaining an internal combustion engine for a vehicle to rotate at the rotating speeds in a range from an idling speed to the maximum speed such as lower than 700 r.p.m. upon depressing of the accelerator 6 from idling to full stroke. A cam follower 8 is engaged with the cam 7, and the cam follower 8 is pivotally secured to a throttle lever 9 fastened to the throttle shaft 2. When a stepping motor is employed as the actuator constructed as described above, the motor opens the throttle valve more than the movement of the stepping motor at the abruptly accelerating time to accelerate the increase in the air amount, thereby accelerating the vehicle.

Further, an engaging pin 10 which is operated by a solenoid S or a finger is provided at the link lever 5 fastened to the cam lever 4, and the pin 10 can be operated to be engaged with a hole 11 formed at the throttle lever 9 by means of a solenoid S or a finger. More particularly, when the pin 10 is engaged with the hole 11 of the throttle lever 9 and the accelerator 6 is depressed, the throttle valve 1 can operate through the link lever 5, the pin 10, the throttle lever 9 and the throttle shaft 2. Thus, even if the actuator thus constructed as described above becomes defective so that the throttle valve becomes impossible to operate, the throttle valve 1 can operated by engaging the pin 10 with the throttle lever 9.

Figure 3:
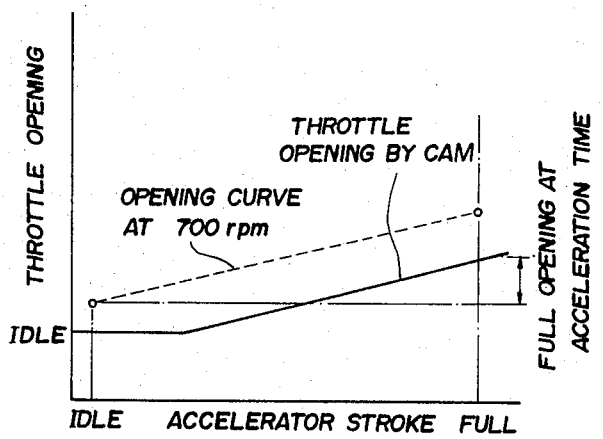
FIG. 3 is a graph showing the relationship between the opening of a throttle by a cam and the stroke of an accelerator.

In FIG. 3, there is shown the relationship between the throttle opening and the accelerator stroke in the range from idle to full stroke. A broken line designates the case of the throttle valve opening when the internal combustion engine rotates at 700 r.p.m., and a solid line designates the throttle valve opening when the engine rotates under the control of the cam.

According to this invention, since the cam lever interlocked to a pedal is provided in addition to the actuator, the throttle valve can be opened more than the movement of the stepping motor even when it is necessary to abruptly accelerate the internal combustion engine and hence the vehicle in case such as racing, thereby accelerating the increase in the air amount to improve the accelerating performance. Thus, the air amount resolving power can be improved at a low reduction gear ratio in low opening of the throttle valve without raising the resolving power of the stepping motor, and the cost can thus be reduced.

Further, the throttle valve can be opened by the depression of the accelerator by engaging the pin with the throttle lever by means of the formation of the coupling relationship of the link lever, the engaging pin, the throttle lever and the throttle shaft even if the actuator becomes defective so that the throttle valve becomes impossible to operate, thereby permitting the vehicle engine to continue operation.

What is claimed is:

1. A rotating mechanism of a throttle valve for a fuel supply device of an internal combustion engine comprising:

an actuator for opening the throttle valve mounted on a throttle shaft upon depressing of an accelerator, said actuator being coupled to one side of the throttle shaft;

a cam lever pivotally secured to an opposite side of the throttle shaft and having a cam set to open the throttle valve more than the movement of said actuator upon depressing of the accelerator, said cam lever being coupled to the accelerator through a link lever;

a throttle lever for coupling the cam lever to the throttle shaft; and an engaging member mounted on a cam lever side of said throttle shaft for selectively taking an engaging position or a nonengaging position relative to the throttle lever, said engaging member being operated to take the engaging position with respect to the throttle shaft when said actuator becomes impossible to operate, the engaging member being located on said link lever and engaging a hole formed in said throttle lever.

2. The rotating mechanism of a throttle valve for a fuel supply device of an internal combustion engine according to claim 1, wherein said actuator is operated to determine the opening of the throttle valve by means of a potentiometer, an encoder and a control unit.

3. The rotating mechanism of a throttle valve for a fuel supply device of an internal combustion engine according to claim 1, wherein said cam lever comprises a cam set to open the throttle lever for maintaining the throttle valve in a range from an idling opening to a full stroke opening.

4. The rotating mechanism of a throttle valve for a fuel supply device of an internal combustion engine according to claim 1, wherein said throttle lever is fastened to the opposite side of the throttle shaft, and a cam follower engaged with the cam is pivotally secured to the throttle lever.

5. The rotating mechanism of a throttle valve for a fuel supply device of an internal combustion engine according to claim 1, wherein said engaging member is operated by a solenoid.

* * * * *